United States Patent [19]

Aureli

[11] 4,044,433

[45] Aug. 30, 1977

[54] WAISTBAND FASTENER HAVING SUBSTANTIALLY IDENTICAL PARTS

[75] Inventor: William D. Aureli, Watertown, Conn.

[73] Assignee: Scovill Manufacturing Company, Waterbury, Conn.

[21] Appl. No.: 753,467

[22] Filed: Dec. 22, 1976

[51] Int. Cl.[2] ..... A44G 13/00

[52] U.S. Cl. ..... 24/227; 24/201 HE

[58] Field of Search ..... 24/226, 227, 229, 201 HA, 24/201 HE; 2/235

[56] References Cited

U.S. PATENT DOCUMENTS

| | | | |
|---|---|---|---|
| 2,778,082 | 1/1957 | Stoughton | 24/201 HE |
| 3,892,015 | 7/1975 | Taylor | 24/225 |

*Primary Examiner*—Bernard A. Gelak

*Attorney, Agent, or Firm*—Dallett Hoopes

[57] ABSTRACT

Waistband fastener has substantially identical parts comprising Y-shaped body having flat body with uniformly spaced legs terminating in offset feet leaving openings between legs so that leg of "hook"-functioning part on one fly flap can hook into opening between two legs of "bar"-functioning part on other flap.a

7 Claims, 6 Drawing Figures

WAISTBAND FASTENER HAVING SUBSTANTIALLY IDENTICAL PARTS

BACKGROUND OF THE INVENTION

1. Field of the Invention:

This invention relates to a waistband fastener. More specifically, the invention relates to a waistband fastener which functions comparably to the well-known hook-and-bar-type waistband fastener usually employed on waistbands of men's trousers. More specifically, the invention relates to a waistband fastener in which the fastener parts are substantially identical.

2. Description of the Prior Art:

In the prior art, there are many different kinds of waistband fasteners used on men's trousers. Probably the most well known is the hook-and-bar-type wherein a hook on the upper or outer flap of the fly engages into a bar on the inner flap to hold the waistband closed. The hood-and-bar-type fastener usually, of course, necessitates the manufacture, storage, and hoppering of two separate engaging elements.

Attempts have been made in the past to form a waistband fastener wherein the parts are identical or substantially identical. Examples of such fasteners are disclosed in the U.S. Pat. No. 870,617, issued Nov. 12, 1907 to Falter, and U.S. Pat. 3,815,183, issued June 11, 1974 to Daddona. Such prior fasteners wherein the two parts have identical halves have been themselves irregular in shape; though meritorious, they have produced problems in feeding and registering.

SUMMARY OF THE INVENTION

Under the present invention, there is provided a fastener having substantially identical fastening parts. The fastener is Y-shaped and comprises three legs extending out from the central body, the legs being uniformly spaced about the body so as to maximize the opportunity for registration in the affixation of the fastener parts to the garment. In a preferred version, one of the legs of the hook-functioning fastener member is deflected slightly outward to facilitate the hooking engagement of the bar-functioning element.

BRIEF DESCRIPTION OF THE DRAWINGS

Other features of the invention will be apparent from a reading of the following specification and an inspection of the drawings, all of which disclose a non-limiting embodiment of the invention. In the drawings.

BRIEF DESCRIPTION OF THE PREFERRED EMBODIMENT

Figure 1:
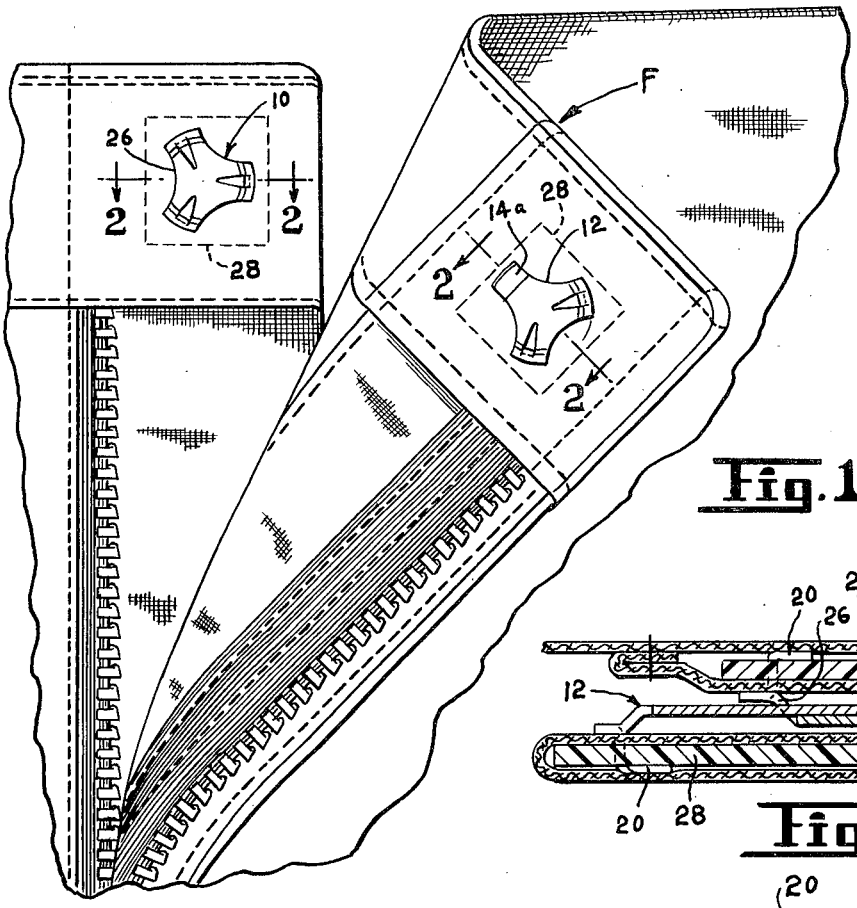
FIG. 1 is a perspective of a trouser fly area and showing a waistband fastener embodying my invention.

Referring more specifically to the drawings, a fastener embodying the invention is applied to the fly F of a man's trousers shown in FIG. 1. The fastener comprises two parts designated 10 and 12, substantially identical in shape. In use, the element or part 10 comprises the bar-functioning part while the element 12 comprises the hook-functioning part.

Figure 5:
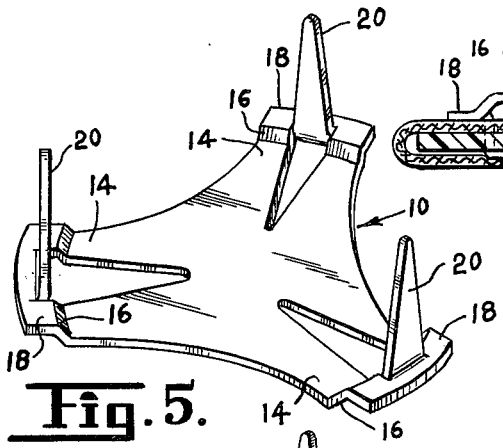
FIG. 5 and 6 are perspective views of other fastener parts respectively.
Figure 6:
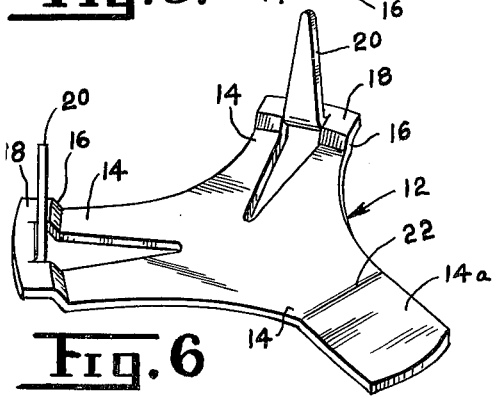

Referring now to FIGS. 5 and 6, the parts 10 and 12 each comprise a Y-shaped body having legs 14 radiating out from a central portion. The legs are uniformly spaced for ease in registering. At the end of each leg, there is a deflected portion 16 from which there is a terminating distal foot 18 offset by portion 16 from the plane of the main central body portion. This arrangement leaves openings between each pair of legs.

The parts are each preferably metal stampings of steel or the like.

Struck downwardly from each leg is a tine 20 which is stamped out of the associated leg portion and deflected to extend perpendicularly to the plane of the central body portion. As shown, the tines are pointed to assist in penetrating fabric.

An exception to the formation of the legs generally is the leg **14*a* of the hook-functioning part 12. In this leg, the distal end is not formed with an offset portion, nor is there a tine struck therefrom. Instead, transverse of the leg 14*a* is a deflection line 22 at which the leg 14*a*** is bent outwardly slightly to assist in the hooking function.

Figure 2:
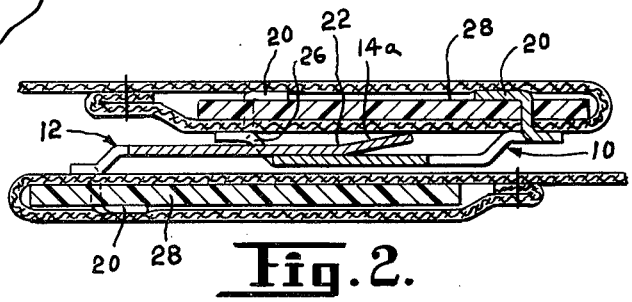
FIG. 2 is an enlarged sectional view taken on the line 2—2 of FIG. 1 showing the fastener parts in inter-engaged condition.

As shown in FIG. 2, the bar-functioning part 10 is mounted so that between two of the legs there is presented an opening 26 (FIG. 1) facing away from the outer flap of the fly F and presenting in effect a bar adapted to be engaged by the hook-functioning part 12.

As shown in FIG. 2, the tines 20 of the part 10 extend through the fabric of the inner flap and through a plastic reinforcing sheet 28 whereupon they are clinched inwardly in a secure fastening.

Also as shown in FIG. 2, the hooking-function part 12 is secured to the outer flap of the fly F (FIG. 1) and disposed so that its hook-like leg **14*a* readily enters opening 26** in hooking engagement.

Just as with part 10, the tines 20 on the legs 14 of the hook-functioning part 12 pierce the fabric of the outer flap, pierce the reinforcing strip 28, and are clinched over inside the fold of the trouser fabric.

Figure 3:
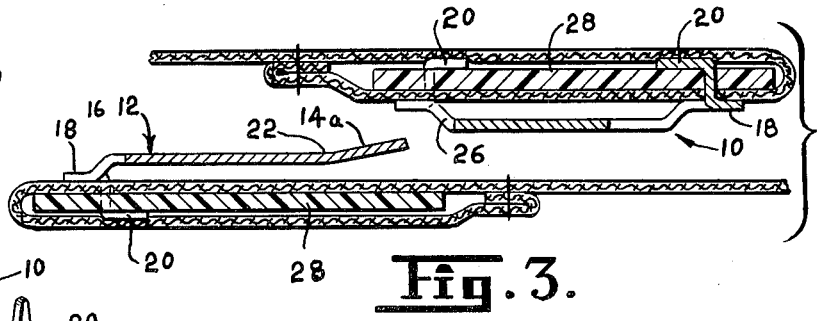
FIG. 3 is a sectional view comparable to FIG. 1 but showing the fastener parts in the process of being engaged or disengaged.

The described attachment tightly secures both fastening members in their proper orientation. As shown in FIG. 3, the hook-functioning part 12 with its hooking leg **14*a* is positioned so as to be readily engageable in opening 26** in the engagement process.

Figure 4:
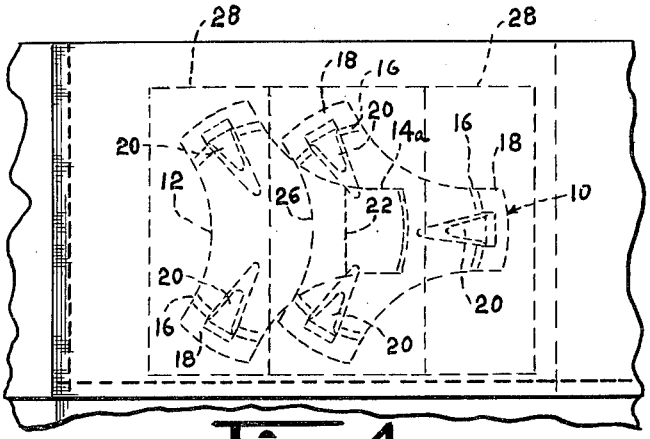
FIG. 4 is a front view of a trouser fly waistband area with fastener parts shown in phantom in inter-engaged condition.

Referring to FIG. 4, it is seen that the hooking leg **14*a* of the hook-functioning member 12 enters the opening 26 quite readily and nests within the member part 10, the central portion of the part 12 resting against the deflecting surfaces 16**.

Once the hook leg **14*a* is engaged in the opening 26**, there is a reliable securement which, easily accomplished, is just as easily reversed, as when it is desired to unhook the waistband.

While the invention has been disclosed in a single embodiment, it is not so limited. The invention is defined by the following claim language and equivalents thereof:

I claim:

1. A waistband assembly comprising a waistband outer flap and an inner flap, the outer surface of the inner flap and the inner surface of the outer flap having affixed thereto respectively a pair of fastener halves, the halves being substantially identical, each half comprising a Y-shaped body having three legs distributed uniformly about the center of the body, the bodies of the two halves being in identical rotary orientation when the units are aligned with one of the legs of each being pointed in the direction of the outer flap and the other legs directed substantially up and down so that one of the legs on the outer flap half may be hooked between the said other legs of the inner flap half, all of the legs except said one leg of the unit on the outer flap being secured to the respective flaps.

2. A waistband assembly as claimed in claim 1 wherein at least two legs on each unit have offset feet resting on the respective flaps whereby the central body portion of the halves are raised off their respective flaps.

3. A waistband assembly as claimed in claim 2 wherein the said leg of the outer flap half is deflected outward slightly from its flap making it more prominent to facilitate the hooking.

4. A waistband assembly as claimed in claim 1 wherein the securing of the legs is accomplished by a prong adjacent the termination of each leg, the prongs extending through the fabric of the respective flaps.

5. A waistband assembly as claimed in claim 1 wherein the units are each made of metal.

6. A waistband fastener having substantially identical halves, each half comprising a generally circular metal plate having an offset margin portion, the plate being formed with three equispaced cutouts about the periphery thereof to define a Y-shaped body having three legs with offset feet, at least two of the feet having attaching prongs struck down therefrom.

7. A waistband fastener having substantially identical halves, each half comprising a Y-shaped body having three uniformly spaced radial legs, each of the legs having a downwardly deflected portion adjacent its end terminating in an offset foot disposed in a plane parallel to the main plane of the body, and an attaching prong extending downward from at least two of the feet.

* * * * *